US006708779B2

(12) United States Patent
Taga

(10) Patent No.: US 6,708,779 B2
(45) **Date of Patent: *Mar. 23, 2004**

(54) REVERSE APPARATUS FOR AIR IMPACT WRENCH

(76) Inventor: Koji Taga, 1-14-1 Tsurugamai, Ohi-machi, Iruma-gun, Saitama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/184,779

(22) Filed: Jun. 27, 2002

(65) Prior Publication Data

US 2003/0037939 A1 Feb. 27, 2003

Related U.S. Application Data

(63) Continuation-in-part of application No. 09/996,334, filed on Nov. 27, 2001, now Pat. No. 6,561,284.

(30) Foreign Application Priority Data

Dec. 28, 2000 (JP) ..... 2000-400761

(51) Int. Cl.[7] ..... B25D 11/10
(52) U.S. Cl. ..... 173/104; 173/93.5; 173/93.6
(58) Field of Search ..... 173/47, 93, 104, 173/168, 169, 170, 177, 218, 221

(56) References Cited

U.S. PATENT DOCUMENTS 3,833,068 A 9/1974 Hall ..... 173/169
5,083,619 A 1/1992 Giardino et al. ..... 173/104
5,303,781 A 4/1994 Lin ..... 173/169
5,377,769 A 1/1995 Hasuo et al. ..... 173/169
5,775,439 A 7/1998 Biek ..... 173/1
5,918,686 A 7/1999 Izumisawa ..... 173/169
6,047,780 A 4/2000 Lin ..... 173/168

*Primary Examiner*—Scott A. Smith
*Assistant Examiner*—Chukwurah Nathaniel
(74) *Attorney, Agent, or Firm*—Hogan & Hartson, LLP

(57) ABSTRACT

A reverse apparatus for an air impact wrench in which pressurized air supplied to an air supply passage provided within a grip is fed via the reverse apparatus to an air motor accommodated within an impact wrench main body, and rotational torque output from the air motor is transmitted to an anvil via an impact mechanism. The reverse apparatus includes a cylindrical bush disposed in a lower portion of the impact wrench main body substantially in parallel with an output shaft of the air motor; a valve member slidably disposed within the bush and having an end projecting from the lower portion of the impact wrench main body, the valve member cooperating with the bush in order to supply pressurized air to one of two air ports of the air motor, when positioned at a first axial position, so as to rotate the anvil clockwise and supply pressurized air to the other air port of the air motor.

2 Claims, 8 Drawing Sheets

REVERSE APPARATUS FOR AIR IMPACT WRENCH

The present invention relates to a reverse apparatus, a CIP of Ser. No. 09/996,334 filed Nov. 27, 2001, now U.S. Pat. No. 6,561,284, for an air impact wrench.

BACKGROUND OF THE INVENTION

1. Field of the Invention

2. Description of the Related Art

As shown in FIG. 5, in a conventional air impact wrench, a cylindrical reverse apparatus R5 is disposed between a trigger 59 and an impact wrench main body 51 and in parallel with an output shaft of an air motor. The reverse apparatus R5 includes a reverse bush fitted to the main body 51 and a reverse valve slidably inserted into the reverse bush.

In the conventional air impact wrench, when the direction of rotation of the air motor is to be changed from clockwise (forward) to counterclockwise (reverse), an operator pushes an end of the reverse apparatus R5 on an end cap 53 side by use of the thumb of the hand that grasps a grip 57, such that an end of the reverse apparatus R5 on an anvil 56 side projects. When the direction of rotation of the air motor is to be changed from counterclockwise (reverse) to clockwise (forward), the operator pushes the end of the reverse apparatus R5 on the anvil 56 side by use of the forefinger of the hand such that the end of the reverse apparatus R5 on the end cap 53 side projects.

As described above, the conventional reverse apparatus requires operation by use of two fingers (thumb and forefinger) of the hand that grasps the grip. In the case of a type of work, such as automobile maintenance and repair work, which must be performed in a narrow work space and in which the direction of rotation of the air impact wrench must be switched frequently, work efficiency tends to decrease.

SUMMARY OF THE INVENTION

In view of the foregoing, an object of the present invention is to provide a reverse apparatus for an air impact wrench which enables an operator to switch the direction of rotation by use of a single finger of the hand that grasps a grip of the air impact wrench.

In order to achieve the above object, the present invention provides a reverse apparatus for an air impact wrench in which pressurized air supplied to an air supply passage provided within a grip is fed via the reverse apparatus to an air motor accommodated within an impact wrench main body, and rotational torque output from the air motor is transmitted to an anvil via an impact mechanism, comprising a cylindrical bush disposed in a lower portion of the impact wrench main body substantially in parallel with an output shaft of the air motor; a valve member slidably disposed within the bush and having an end projecting from the lower portion of the impact wrench main body, the valve member cooperating with the bush in order to supply pressurized air to one of two air ports of the air motor, when positioned at a first axial position, so as to rotate the anvil clockwise and supply pressurized air to the other air port of the air motor, when positioned at a second axial position, so as to rotate the anvil counterclockwise; and a cam mechanism disposed within the bush and operatively coupled to the valve member so as to position the valve member to the first and second axial positions alternately whenever the projecting end of the valve member is pushed inward.

Preferably, the cam mechanism comprises a circumferentially extending cam provided on an inner circumferential surface of the bush, the cam having a plurality of axially extending grooves circumferentially arranged at a predetermined pitch and circumferentially extending engagement surfaces each formed between corresponding two of the grooves; a spring support attached to one end of the bush; a first spring attached to the spring support; a spin ring rotatably disposed within the bush and having a plurality of convex portions formed on a circumferential surface thereof, the convex portions being caused to enter the grooves or run onto the engagement surfaces between the grooves; a cam roll rotatably disposed within the bush and having at an axial end thereof a cam surface to be engaged with the convex portions of the spin ring, the cam surface having a profile such that each time the cam roll is moved axially, the spin ring is rotated by an angle corresponding to half the pitch of the grooves; and a second spring disposed within the bush and adapted to maintain mutual contact among the spin ring, the cam roll, and the valve member, the second spring generating force being smaller than that generated by the first spring.

Preferably, the bush has an air inlet port communicating with the air supply passage and first and second air feed ports communicating with the air ports of the air motor, the air feed ports being located on opposite sides of the air inlet port with respect to the axial direction; and the valve member has a changeover portion having a diameter substantially equal to an inner diameter of the bush, the changeover portion moving to a position between the first air feed port and the air inlet port when the valve member is moved to the first axial position and moving to a position between the air inlet port and the second air feed port when the valve member is moved to the second axial position.

More preferably, a regulation lever is attached to the projecting end of the valve member; and the valve member has an opening control portion formed adjacent to the changeover portion for controlling the opening of the air inlet port when the valve member is rotated upon rotation of the regulation lever.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A preferred embodiment of the present invention will be described with reference to the drawings.

Figure 1:
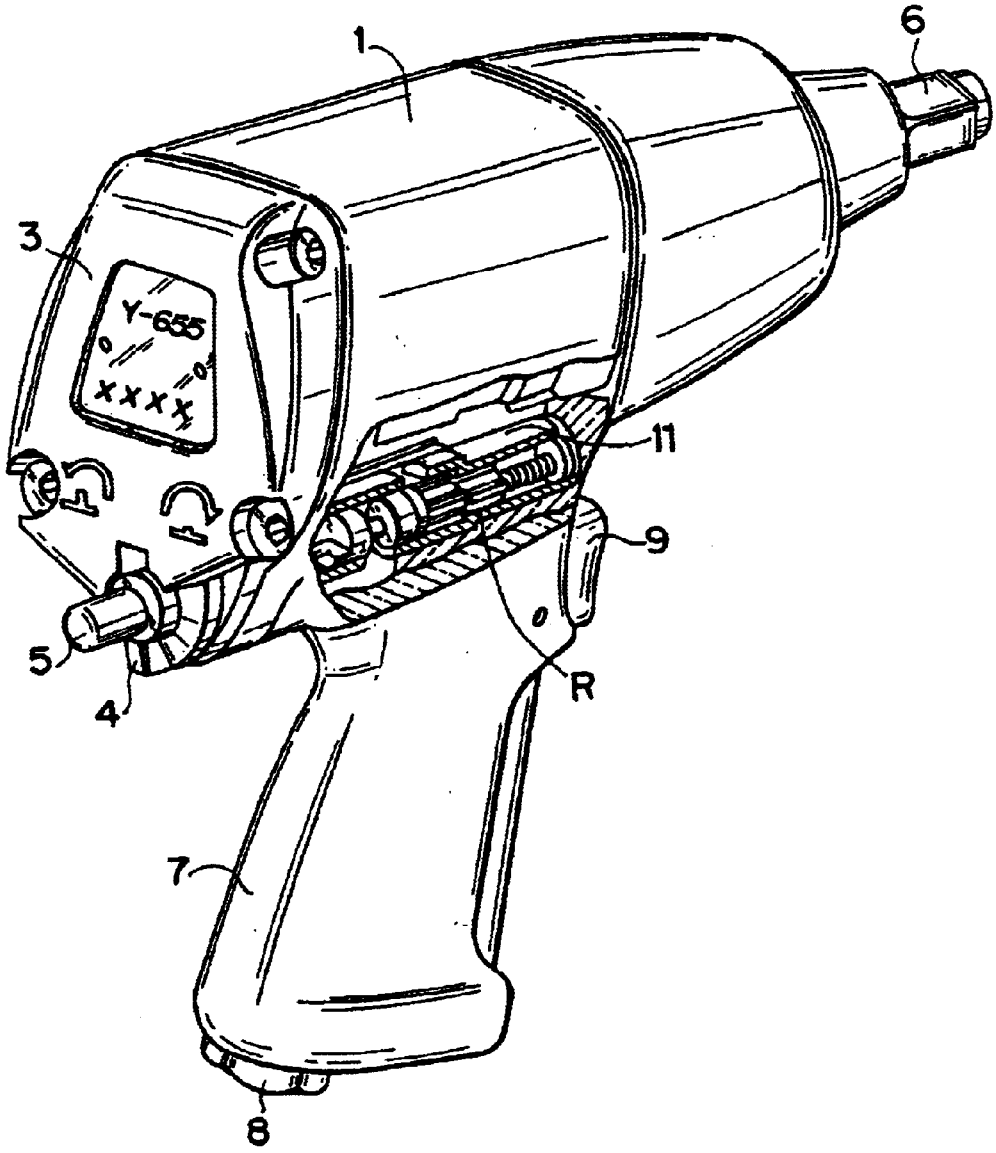
FIG. 1 is a perspective view of an air impact wrench according to an embodiment of the present invention.

In FIG. 1, reference numeral 1 denotes an impact wrench main body, in which an air motor M (see FIGS. 3 and 4) is accommodated. Rotational torque output from an output shaft of the air motor M is transmitted to an anvil 6 via an impact mechanism called an impact clutch. An end cap 3 is affixed to the rear end of the impact wrench main body 1 by use of bolts.

A grip 7 is integrally fixed to a lower portion of the impact wrench main body 1. An air supply passage 8 is provided in the grip 7, and the lower end of the air supply passage 8 is connected to an air hose (not shown). A reverse apparatus R is disposed in the lower portion of the impact wrench main body 1 to be located in the vicinity of a location where the grip 7 is affixed to the lower portion. The reverse apparatus R extends in parallel with an output shaft of the air motor M.

In addition to the air supply passage 8, an unillustrated air release passage is provided within the grip 7. These passages communicate with air ports of the air motor M via the reverse apparatus R. Reference numeral 9 denotes a trigger, which is pivotably attached to the upper front portion of the grip 7. An unillustrated open/close valve is disposed within the air supply passage 8 and connected to the trigger 9. When the trigger 9 is operated to open the air supply passage 8, pressurized air is supplied to the air motor M via the reverse apparatus R. As will be described in detail, the reverse apparatus R changes the rotational direction of the air motor M; i.e., the anvil 6.

Figure 2:
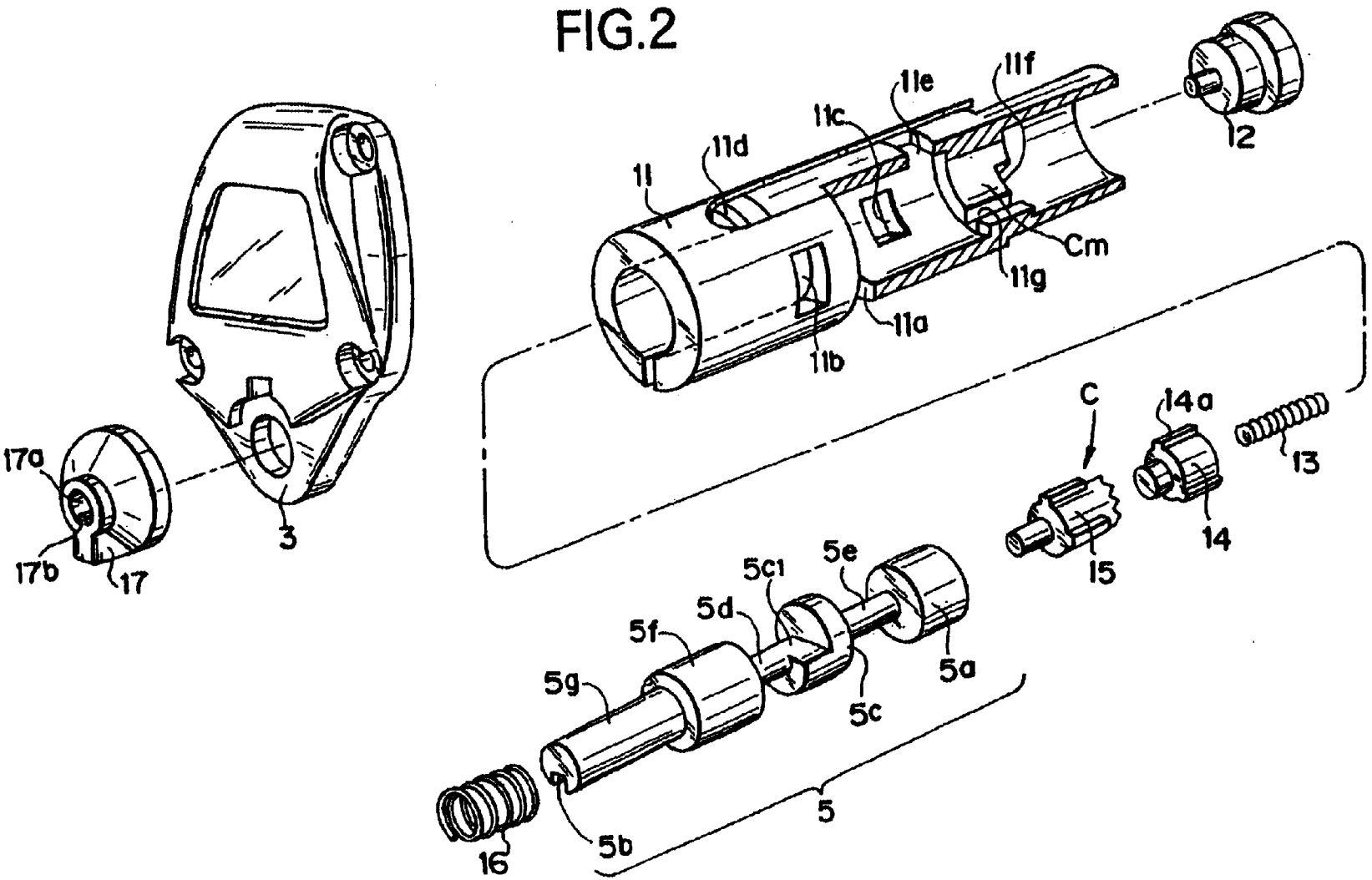
FIG. 2 is an exploded perspective view of a reverse apparatus of the air impact wrench of FIG. 1.

As shown in FIG. 2, the reverse apparatus R includes a cylindrical reverse bush 11 inserted and fitted into the lower portion of the impact wrench main body 1, and a knock reverse valve (valve member) 5 slidably disposed within the reverse bush 11 such that one end of the knock reverse valve 5 projecting from a rear surface of a lower portion of the impact wrench main body 1. The knock reverse valve 5 has a cam mechanism C for positioning the knock reverse valve 5 at two axial positions within the reverse bush 11. When the knock reverse valve 5 is positioned at a first axial position, pressurized air is supplied to one of two air ports of the air motor M so as to rotate the anvil 6 clockwise. When the knock reverse valve 5 is positioned at a second axial position, pressurized air is supplied to the other air port of the air motor M so as to rotate the anvil 6 counterclockwise.

The cam mechanism C is disposed within the reverse bush 11 and operatively coupled to the knock reverse valve 5 so as to position the knock reverse valve 5 to the first and second axial positions alternately whenever the projecting end of the knock reverse valve 5 is pushed inward.

Next, the cam mechanism C shown in FIG. 2 will be described in detail. The cam mechanism C includes a cam Cm, a spring support 12, a push spring (first spring) 13, a spin ring 14, a cam roll 15, and a second spring 16. The cam Cm is formed on the inner circumferential surface of the reverse bush 11 and extends in the circumferential direction. The cam Cm has a plurality of axially extending grooves 11*g*, which are circumferentially arranged at a predetermined pitch, and circumferentially extending engagement surfaces 11*f*, each of which is formed between corresponding two of the grooves 11*g*. The spring support 12 is attached to one open end of the reverse bush 11 in order to close the open end of the reverse bush 11. The push spring 13 is attached to the spring support 12. The spin ring 14 is rotatably disposed within the reverse bush 11 and has a plurality of axially extending convex portions 14*a*, which are formed on a circumferential surface thereof at the same pitch as that of the grooves 11*g*. The convex portions 14*a* are caused to enter the grooves 11*g* or run onto the engagement surfaces 11*f* between the grooves 11*g*. The cam roll 15 is rotatably disposed within the reverse bush 11 and has at an axial end thereof a cam surface to be engaged with the convex portions 14*a* of the spin ring 14. The cam surface has a profile such that each time the cam roll 15 is moved axially, the spin ring 14 is rotated by an angle corresponding to half the pitch of the grooves 11*g*. The second spring 16 is disposed within the reverse bush 11 and is located between the end cap 3 and the knock reverse valve 5, so that the second spring 16 urges the knock reverse valve 5 away from the end cap 3. The second spring 16 generates force which is smaller than that generated by the push (first) spring 13. Thus, the second spring 16 maintain mutual contact among the spin ring 14, the cam roll 15, and the knock reverse valve 5.

Figure 6:
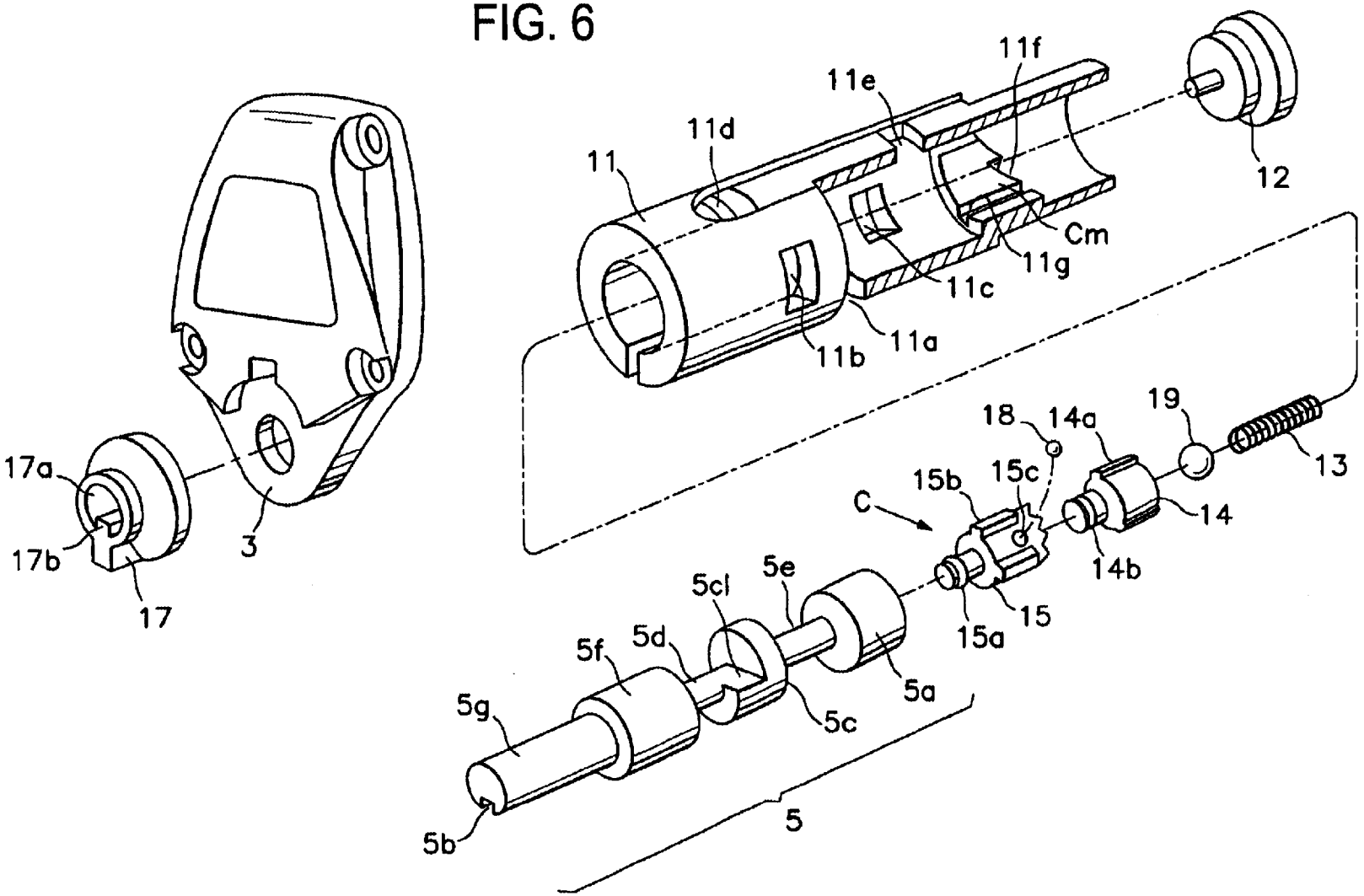
FIG. 6 is an exploded perspective view of a reverse apparatus of an air impact wrench according to the other embodiment of the present invention.

Further, the cam mechanism C shown in FIG. 6 will be described in detail. The cam mechanism C includes a cam Cm, a spring support 12, a push spring (first spring) 13, a spin ring 14, a cam roll 15, a first steel ball 19 and a second steel ball 18. The cam Cm is formed on the inner circumferential surface of the reverse bush 11 and extends in the circumferential direction. The cam Cm has a plurality of axially extending grooves 11*g*, which are circumferentially arranged at a predetermined pitch, and circumferentially extending engagement surfaces 11*f*, each of which is formed between corresponding two of the grooves 11*g*. The spring support 12 is attached to one open end of the reverse bush 11 in order to close the open end of the reverse bush 11. The push spring 13 is attached to the spring support 12. The first steel ball 19 is inserted between the push spring 13 and the spin ring 14. The spin ring 14 is rotatably disposed within the reverse bush 11 and has a plurality of axially extending convex portions 14*a*, which are formed on a circumferential surface thereof at the same pitch as that of the grooves 11*g*. The convex portions 14*a* are caused to enter the grooves 11*g* or run onto the engagement surfaces 11*f* between the grooves 11*g*. The cam roll 15 is rotatably disposed within the reverse bush 11 and has at an axial end thereof a cam surface to be engaged with the convex portions 14*a* of the spin ring 14. The cam surface has a profile such that each time the cam roll 15 is moved axially, the spin ring 14 is rotated by an angle corresponding to half the pitch of the grooves 11*g*. The second ball 18 is disposed at a penetrated round hole 15*c* which is formed on the cylindrical surface of the cam roll 15. The second ball 18 is inserted in a loop groove 14*b* which is formed on the spin ring 14. The second ball 18 is slidably disposed on the engagement surfaces 11*f*. And the cam roll 15 is rotatably attached to an anvil side and portion 5*a* by means of a circular cam roll stopper 15*a*. Therefore, the knock reverse valve 5, the cam roll 15 and the spin ring 14 are coupled one another, and a second spring 16 is not necessary to the cam mechanism shown in FIG. 6.

Next, the specific configurations of the reverse bush 11 and the knock reverse valve 5 will be described. An air inlet port 11*a* communicating with the air supply passage 8, two air feed ports 11*b* and 11*c* communicating with the air ports of the air motor M, and two air release ports 11*d* and 11*e* communicating with the air release passage provided within the grip 7 are formed in the side wall of the reverse bush 11.

In the reverse apparatus according to the present embodiment, the air inlet port 11*a* is formed in a lower-side middle portion of the reverse bush 11 and communicates with the air supply passage 8 provided within the grip 7. The air feed port 11*b* is formed in a side portion of the reverse bush 11 which is located on the side toward the viewer of FIG. 2, to be located on the end cap 3 side with respect to the air inlet port 11*a*. The air feed port 11*c* is formed in a side portion of the reverse bush 11 which is located on the side away from the viewer of FIG. 2, to be located on the anvil 6 side with respect to the air inlet port 11*a*. The air release port 11*d* is formed in an upper portion of the reverse bush 11 to be located on the end cap 3 side with respect to the air feed port 11*b;* and the air release port 11*e* is formed in the upper portion of the reverse bush 11 to be located on the anvil 6 side with respect to the air feed port 11*c*.

Figure 3:
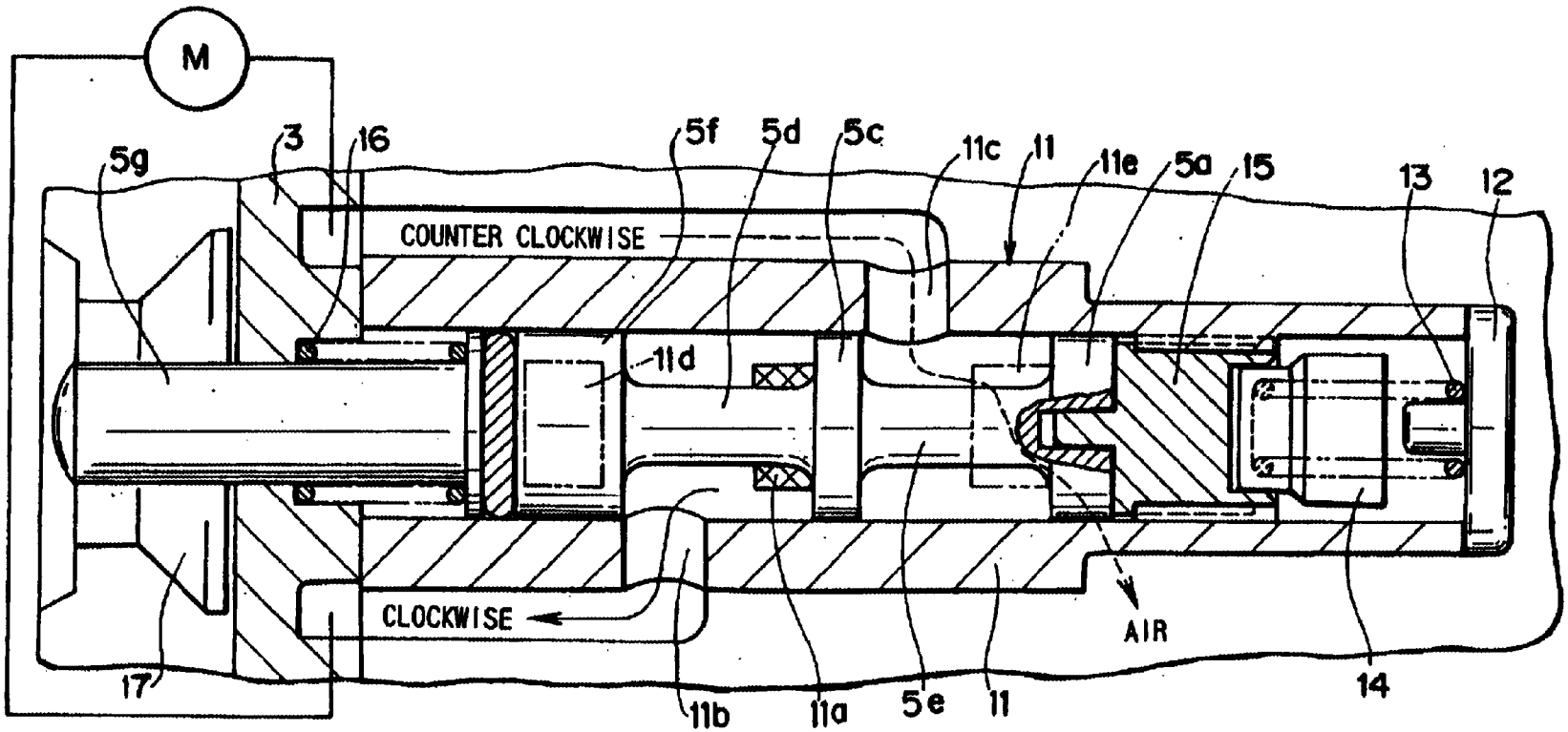
FIG. 3 is a sectional view showing operation of the reverse apparatus in a state in which the reverse apparatus has been switched to clockwise rotation.

As shown in FIGS. 2 and 3, the knock reverse valve 5 has portions of different diameters and axially arranged from the anvil side toward the end cap side. Specifically, an anvil-side end portion 5*a* has a diameter substantially equal to the inner diameter of the reverse bush 11. A first small diameter portion 5*e* adjacent to the anvil-side end portion 5*a* has a diameter substantially half the inner diameter of the reverse bush 11. A changeover portion 5*c* adjacent to the first small diameter portion 5*e* has a diameter substantially equal to the inner diameter of the reverse bush 11. Further, an opening control portion 5*c*1 having a semicircular cross section is formed on the left-hand side of the changeover portion 5*c*. The opening control portion 5*c*1 has a radius substantially equal to the inner radius of the reverse bush 11. A second small diameter portion 5*d* adjacent to the opening control portion 5*c*1 has a diameter substantially half the inner diameter of the reverse bush 11. A large diameter portion 5*f* adjacent to the second small diameter portion 5*d* has a diameter substantially equal to the inner diameter of the reverse bush 11. A knock portion 5*g* adjacent to the large diameter portion 5*f* is slightly smaller in diameter than the large diameter portion 5*f* and receives the above-mentioned spring 16. The above-mentioned spring 16 is omitted in the reverse apparatus of FIG. 6, but a structure of a knock reverse valve of FIG. 6 and FIG. 2 are approximately the same.

Moreover, a regulation lever 17 is supported on the end cap 5 in such a manner that the regulation lever 17 can rotate about the axis of the knock reverse valve 5 relative to the end cap 5, and its axial movement relative to the end cap 5 is restricted. The regulation lever 17 has a fitting hole 17*a,* and a key 17*b* is formed on the wall of the fitting hole 17*a*. A key groove 5*b* is formed on an end-cap-side end portion of the knock reverse valve 5. The end-cap-side end portion of the knock reverse valve 5 is inserted into the fitting hole 17*a* of the regulation lever 17 in such a manner that the key 17*b* is received by the key groove 5*b*.

As described above, the reverse apparatus R has a structure such that the push spring 13, the spin ring 14, and the car roll 15 are placed within the space defined by the cylindrical reverse bush 11 and the spring support 12 and that upon an axial movement of the cam roll 15, the spin ring 14 rotates over an angle half the pitch of the grooves 11*g,* so that the convex portions 14*a* enter the corresponding grooves 11*g* of the cam Cm or abut the engagement surfaces 11*f* of the cam Cm. Therefore, when the cam roll 15 is pushed by means of the anvil-side end portion 5*a* of the knock reverse valve 5 and the convex portions 14*a* enter the corresponding grooves 11*g* of the cam Cm, the knock reverse valve 5 moves axially to a position shown in FIG. 4, so that the air impact wrench rotates counterclockwise. When the cam roll 15 is pushed again, the convex portions 14*a* leave the grooves 11*g* of the cam Cm and run onto the engagement surfaces, so that the knock reverse valve 5 moves axially to a position shown in FIG. 3. As a result, the air impact wrench rotates clockwise. In this state, the spring 16 holds the knock reverse valve 5 in order to prevent the knock reverse valve 5 from returning toward the end cap 3 side.

The flow of air within the reverse apparatus R will be described with reference to FIGS. 3 and 4.

FIG. 3 is a sectional view showing operation of the reverse apparatus in a state in which the reverse apparatus R has been switched to clockwise rotation. When the knock reverse valve 5 is positioned at the position shown in FIG. 3 as a result of the knock portion 5*g* of the knock reverse valve 5 being pushed, the changeover portion 5*c* moves to the anvil side with respect to the air inlet port 11*a,* and the anvil-side end portion 5*a* moves to a position on the anvil side with respect to the air release port 11*e,* so that the large diameter portion 5*f* closes the air release port 11*d*. As a result, air introduced from the air inlet port 11*a* flows into the air feed port 11*b,* so that pressurized air is fed to one air port of the air motor M so as to rotate the air motor M clockwise. Remaining air released from the air motor M is caused to pass through the air feed port 11*c* and is released to the above-mentioned air release passage from the air release port 11*e*. When the knock reverse valve 5 is positioned at the position shown in FIG. 3, the opening control portion 5*c*1 formed adjacent to the changeover portion 5*c* moves to an axial position corresponding to that of the air inlet port 11*a*. Therefore, if the operator rotates the regulation lever 17, the degree of opening of the air inlet port 11*a* is changed by the opening control portion 5*c*1, so that the flow rate of air passing through the air inlet port 11*a* is controlled.

Figure 4:
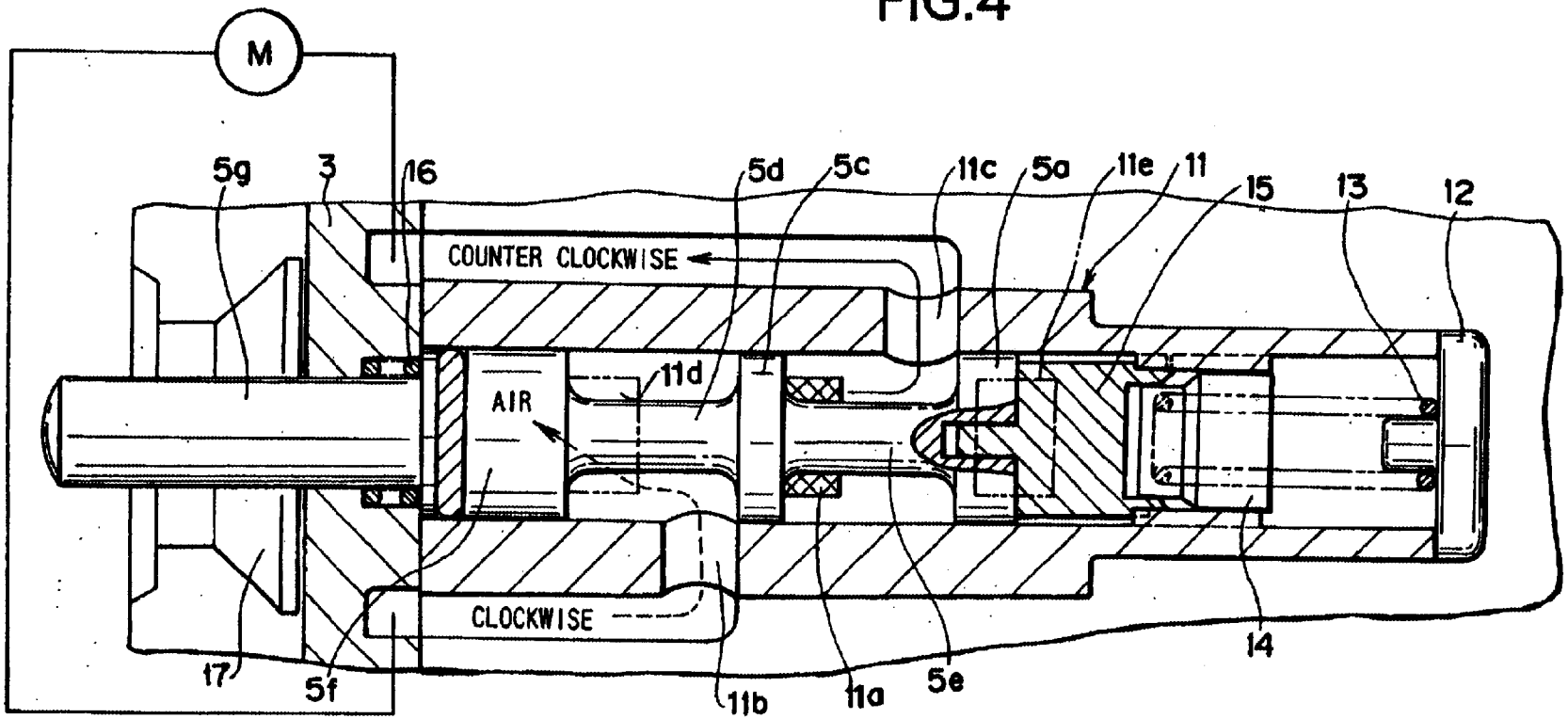
FIG. 4 is a sectional view showing operation of the reverse apparatus in a state in which the reverse apparatus has been switched to counterclockwise rotation.
Figure 5:
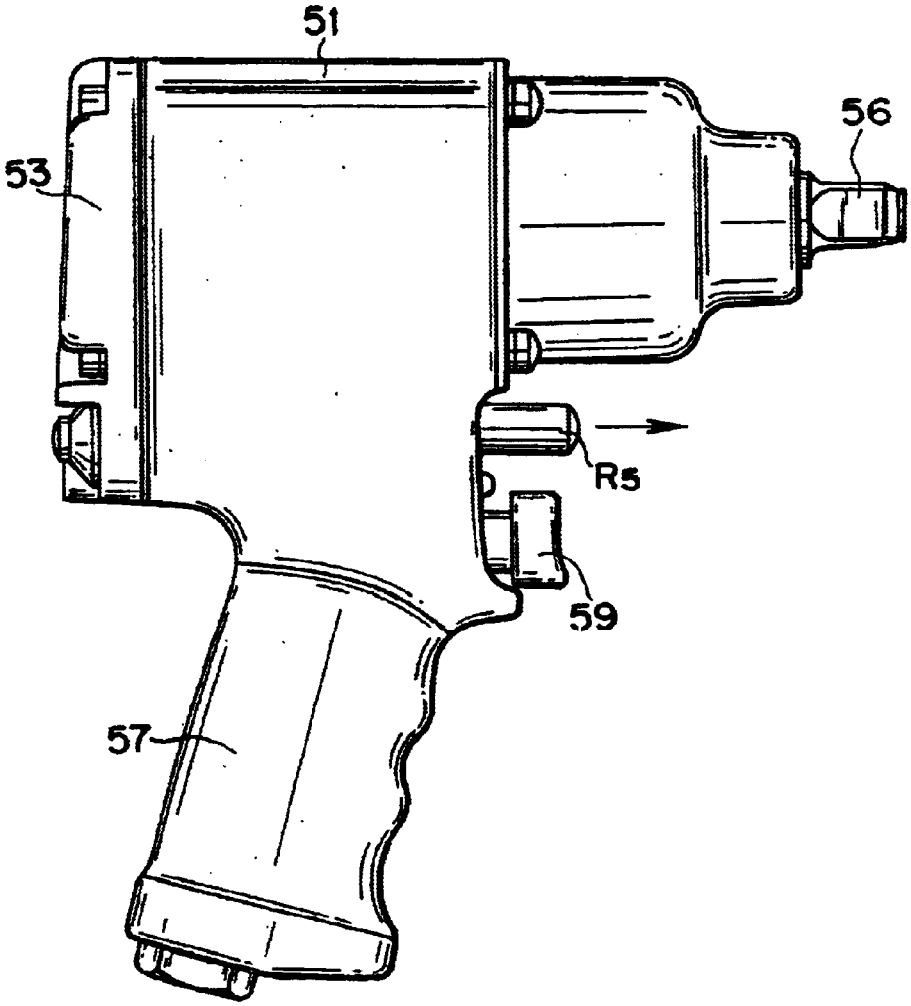
FIG.5 (PRIOR ART)
FIG. 5 is a front view of a conventional air impact wrench.
Figure 7:
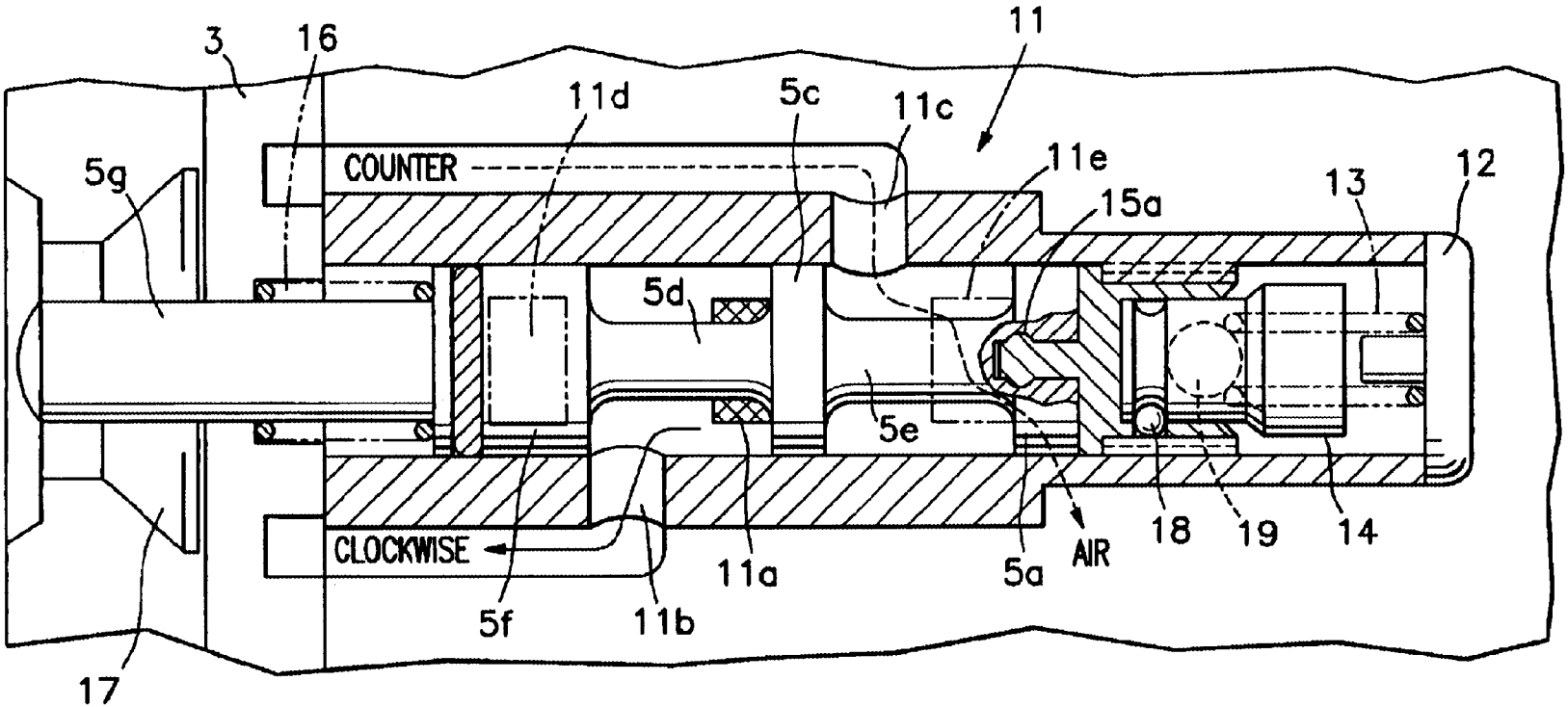
FIG. 7 is a sectional view showing operation of the reverse apparatus of FIG. 6 in a state in which the reverse apparatus has been switched to clockwise rotation.
Figure 8:
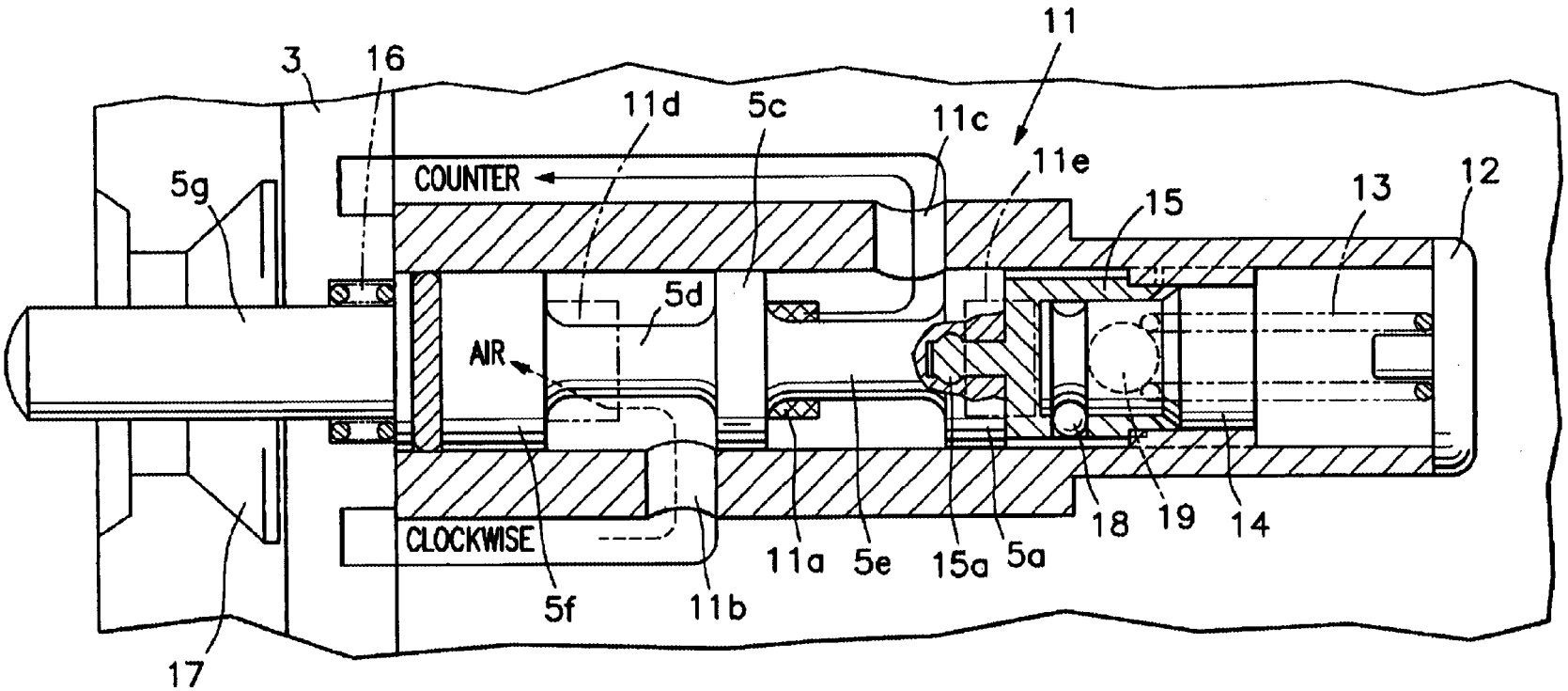
FIG. 8 is a sectional view showing operation of the reverse apparatus of FIG. 6 in a state in which the reverse apparatus has been switched to counterclockwise rotation.

FIG. 4 is a sectional view showing operation of the reverse apparatus in a state in which the reverse apparatus R has been switched to counterclockwise rotation. When the knock reverse valve 5 is positioned at the position shown in FIG. 4 as a result of the knock portion 5*g* of the knock reverse valve 5 being pushed again, the knock reverse valve 5 projects from the end cap 3. As a result, the changeover portion 5*c* moves to the end cap side with respect to the air inlet port 11*a,* and the anvil-side end portion 5*a* and the cam roll 15 fixed thereto move to a position corresponding to the air release port 11*e* so as to close the air release port 11*e*. Further, the large diameter portion 5*f* moves to a position on the end cap side with respect to the air release port 11*d*. As a result, air introduced from the air inlet port 11*a* flows into the air feed port 11*c,* so that pressurized air is fed to the other air port of the air motor M so as to rotate the air motor M counterclockwise. Remaining air released from the air motor M is caused to pass through the air feed port 11*b* and is released to the above-mentioned air release passage from the air release port 11*d*. The flow of air within the reverse apparatus of FIG. 6 shown in FIGS. 7 and 8 and the flow of air shown in FIGS. 3 and 4 are approximately the same.

As described in detail above, the reverse apparatus of the present invention has a cam mechanism for moving the knock reverse valve to the first and second axial positions alternately whenever the projecting end of the knock reverse valve is pushed inward. Therefore, the operator can switch the direction of rotation by use of a single finger of the hand that grasps the grip of the air impact wrench.

Further, a regulation lever is provided on the end cap and is engaged with the knock reverse valve, which has an opening control portion for adjusting the flow rate of air flowing through the air inlet port upon rotation of the knock reverse valve. Therefore, the operator can adjust the flow rate of air supplied to the air motor through a simple operation of rotating the regulation lever.

Obviously, numerous modifications and variations of the present invention are possible in light of the above teachings. It is therefore to be understood that within the scope of the appended claims, the present invention may be practiced otherwise than as specifically described herein.

What is claimed is:

1. A reverse apparatus for an air impact wrench in which pressurized air supplied to an air supply passage provided within a grip is fed via the reverse apparatus to an air motor accommodated within an impact wrench main body, and rotational torque output from the air motor is transmitted to an anvil via an impact mechanism, comprising:

a cylindrical bush disposed in a lower portion of the impact wrench main body substantially in parallel with an output shaft of the air motor;

a valve member slidably disposed within the bush and having an end projecting from the lower portion of the impact wrench main body, the valve member cooperating with the bush in order to supply pressurized air to one of two air ports of the air motor, when positioned at a first axial position, so as to rotate the anvil clockwise and supply pressurized air to the other air port of the air motor, when positioned at a second axial position, so as to rotate the anvil counterclockwise; and a cam mechanism disposed within the bush and operatively coupled to the valve member so as to position the valve member to the first and second axial positions alternately whenever the projecting end of the valve member is pushed inward, wherein the cam mechanism comprises:

a circumferentially extending cam provided on an inner circumferential surface of the bush, the cam having a plurality of axially extending grooves circumferentially arranged at a predetermined pitch and circumferentially extending engagement surfaces each formed between corresponding two of the grooves;

a spring support attached to one end of the bush;

a first spring attached to the spring support;

a spin ring rotatably disposed within the bush and having a plurality of convex portions formed on a circumferential surface thereof, the convex portions being caused to enter the grooves or run onto the engagement surfaces between the grooves;

a first ball inserted between the first spring and the spin ring;

a cam roll rotatably disposed within the bush and having at an axial end thereof a cam surface to be engaged with the convex portions of the spin ring, the cam surface having a profile such that each time the cam roll is moved axially, the spin ring is rotated by an angle corresponding to half the pitch of the grooves; and a second ball disposed at a penetrated round hole which is formed on the cylindrical surface of the cam roll, inserted in a loop groove which is formed on the spin ring, and slidably disposed on the engagement surfaces.

2. A reverse apparatus for an air impact wrench according to claim 1, wherein the cam roll is rotatably attached to an anvil side end portion by means of a circular roll stopper.

* * * * *